US007823664B2

(12) United States Patent
Massey et al.

(10) Patent No.: US 7,823,664 B2
(45) Date of Patent: Nov. 2, 2010

(54) CORROSION PROTECTION FOR HEAD SECTION OF EARTH BORING BIT

(75) Inventors: Alan J. Massey, Houston, TX (US); David K. Luce, Splendora, TX (US); Eric Sullivan, Houston, TX (US); John F. Bradford, III, Fort Worth, TX (US); Carmel Z. El Hakam, Houston, TX (US); James L. Overstreet, Tomball, TX (US); Ajay V. Kulkarni, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/191,915

(22) Filed: Aug. 14, 2008

(65) Prior Publication Data

US 2009/0044984 A1 Feb. 19, 2009

Related U.S. Application Data

(60) Provisional application No. 60/956,441, filed on Aug. 17, 2007.

(51) Int. Cl.
*E21B 10/46* (2006.01)

(52) U.S. Cl. ..... 175/374; 175/425

(58) Field of Classification Search ..... 175/374, 175/425; 148/217, 218, 220
See application file for complete search history.

(56) References Cited

U.S. PATENT DOCUMENTS

| | | | | |
|---|---|---|---|---|
| 3,158,214 | A | 11/1964 | Wisler et al. | |
| 5,553,681 | A * | 9/1996 | Huffstutler et al. | 175/339 |
| 5,577,298 | A * | 11/1996 | Morell | 19/288 |
| 5,791,423 | A | 8/1998 | Overstreet et al. | |
| 6,360,832 | B1 | 3/2002 | Overstreet et al. | |
| 6,450,271 | B1 | 9/2002 | Tibbitts et al. | |
| 6,874,388 | B2 | 4/2005 | Crowe et al. | |
| 6,955,233 | B2 * | 10/2005 | Crowe et al. | 175/374 |
| 7,100,712 | B2 | 9/2006 | Crowe et al. | |
| 2005/0252691 | A1 | 11/2005 | Bramlett et al. | |
| 2006/0027402 | A1 | 2/2006 | Crowe et al. | |
| 2006/0207803 | A1 * | 9/2006 | Overstreet | 175/374 |

FOREIGN PATENT DOCUMENTS

| | | |
|---|---|---|
| WO | WO 99/39075 | 8/1999 |

* cited by examiner

*Primary Examiner*—Giovanna C Wright
(74) *Attorney, Agent, or Firm*—Bracewell & Giuliani LLP

(57) ABSTRACT

An earth boring bit has a steel body having at least one leg with a depending bearing pin. A cone having cutting elements is rotatably mounted to the bearing pin. A ball plug weld is on the outer surface of the leg. A layer of hardfacing applied to part of the outer surface of the leg, the hardfacing having carbide particles in a matrix. A corrosion resistant coating containing at least 50% nickel is formed on parts of the outer surface of the leg that are free of the layer of hardfacing both above and below the ball plug weld.

21 Claims, 4 Drawing Sheets

CORROSION PROTECTION FOR HEAD SECTION OF EARTH BORING BIT

CROSS-REFERENCE TO RELATED APPLICATION

This application claims priority to provisional application Ser. No. 60/956,441, filed Aug. 17, 2007.

FIELD OF THE INVENTION

This invention relates in general to earth boring bits, and in particular to a protective layer formed on exposed outer surfaces of the bit to protect against corrosion that may lead to leg breakage.

BACKGROUND OF THE INVENTION

One type of earth boring bit has a steel body with at least one bit leg, normally three, or it could have four, such as for a pilot reamer. A cone with cutting elements is rotatably mounted to a bearing pin depending from each bit leg. Hardfacing is typically applied to part of the outer surface of each bit leg. Alternately, the bit leg may have tungsten carbide compacts pressed into the outer surface alone or in combination with hardfacing. The hardfacing is usually a mixture of carbide particles in a matrix of iron, nickel or cobalt, or alloys thereof.

In some geographic areas, bit legs have been known to break. The fracture is often in the vicinity of the weld on the ball plug. The ball plug and weld close the outer end of a passage for inserting balls into a locking arrangement between the cone and the bearing pin.

SUMMARY

The bit has a steel body having at least one leg with a depending bearing pin. A cone having cutting elements is rotatably mounted to the bearing pin. An anti-corrosive coating is formed on an outer surface of the leg to reduce the tendency for leg breakage. The coating comprises an alloy selected from the group consisting of iron, nickel, chromium, copper, aluminum, zirconium, and silicon. Preferably, the coating; comprises a nickel-based; alloy containing at least 50% nickel. The coating may also be a polymer, such as an adhesive or epoxy. A ball plug weld is on the outer surface of the leg. The coating is preferably located above and below the ball plug weld and may be on the weld itself.

The bit may has a layer of hardfacing on portions of the outer surface of the leg, and other portions of the outer surface of the leg are free of the layer of hardfacing. The bit-leg may also have tungsten carbide compacts pressed into the outer surface, along or in combination with hardfacing. Further, the bit leg may be free of hardfacing or compacts. The hardfacing may be formed of carbide particles in a steel alloy matrix. The coating is preferably located on the other portions of the outer surface of the leg, but the coating could also overly the hardfacing and/or the Compacts. The coating may also be located on an inner surface of the leg.

DETAILED DESCRIPTION OF THE INVENTION

Figure 1:
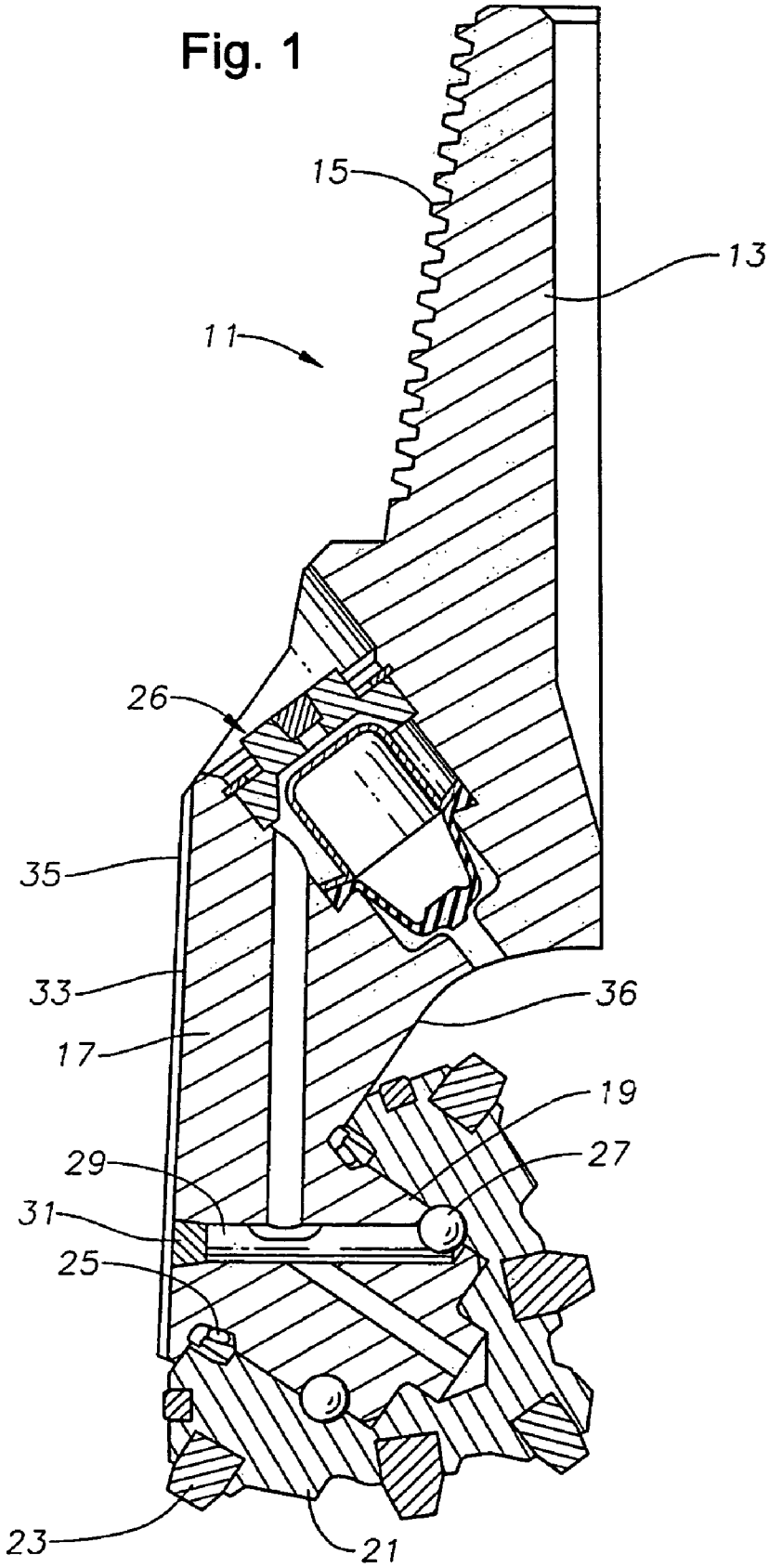
FIG. 1 is a quarter-sectional view of an earth boring bit having a protective layer that is exaggerated in thickness.

Referring to FIG. 1, bit 11 has a body 13 formed of a steel alloy material. Body 13 has threads 15 on its upper end for securing to a drill string. Body 13 normally has three bit legs 17 (only one shown) extending downward from body 13. Alternately, body 13 could have; four bit legs 17, such as in the case of a pilot reamer. A bearing pin 19 depends downward and inward from each bit leg 17.

A cone 21 mounts rotatably on each bearing pin 19. Cone 21 has a plurality of cutting elements 23. In the example shown, cutting elements 23 comprise tungsten carbide compacts that are press-fitted into mating holes in cone 21, but they could alternately comprise milled teeth. A seal assembly 25 seals lubricant in the bearing spaces between bearing pin 19 and cone 21. A pressure compensator assembly 26 equalizes the pressure of the lubricant within the bearing spaces to the borehole fluid pressure.

The retaining system for retaining cone 21 on bearing pin 19 comprises a plurality of balls 27. Each ball 27 fits between mating grooves on bearing pin 19 and in the cavity of cone 21. Balls 27 are inserted through a passage that is plugged by a ball plug 29 after assembly. A weld 31 is made at the outer end of ball plug 29 to secure it in place.

Bit leg 17 has an outer surface 33 that is a segment of a cylinder slightly under the diameter of the hole being drilled. A protective coating or layer 35 is formed on each bit leg outer surface 33 for inhibiting corrosion, particularly in high stress areas. Portions of bit leg 11 undergo higher stress than other portions while drilling due to the weight imposed on the bit, creating cracks. If the drilling fluid contains corrosive materials, such as chloride, the fluid may lower the threshold for crack growth, which can result in bit leg 17 breaking. Protective layer 35 is a material that protects the areas of bit 11 that encounter high stress, inhibiting the corrosive drilling fluid from entering the cracks.

Preferably, protective layer 35 is a layer formed of a material that is less susceptible to corrosion than is the steel body 13. Suitable metals include alloys of iron, nickel, chromium, copper, aluminum, zirconium, and silicon. In one example, protective layer 35 is a nickel-based alloy containing at least 50% nickel. More specifically, the alloy may comprise approximately 60% nickel, 22% chromium, 9% molybdenum; and 4% niobium. Alternately, protective layer 35 could be formed of a polymer, such as an epoxy or adhesive. Protective layer 35 is not intended to be a hardfacing by itself. The hardness of protective layer 35 will not necessarily be greater than the hardness of steel body 13 and may be less. The smoothness or surface finish of protective layer 35 is not significant, and it can be rougher in texture than steel body 13.

Protective layer 35 is illustrated in FIG. 1 as covering substantially all of the exposed surfaces of bit leg outer surface 33. However; it could be applied only to areas that encounter higher stress, such as the area in the vicinity above and below ball plug weld 31 as well as directly on ball plug weld 31. Another area of higher stress is on the inside surface 36 of bit leg 17. Protective layer 35 may also be located on portions of inside surface 36.

Protective layer 35 may be applied in several known manners. If made up of a metallic material, protective layer may be applied in any manner that provides sufficient bonding to the steel body 13 for drilling operations. These processes include but are not limited to spraying, welding, cladding or plating. The spraying may be a type that occurs at a relatively low temperature to avoid damage to seal assembly 25, such as high velocity oxygen fuel (HVOF) process. In that technique, after sand blasting to roughen outer surface 33 of bit leg 17, a fine powder of the metallic alloy is discharged at a high velocity through a torch onto the steel surface. This process causes the powder droplets to deform or melt slightly as they strike the steel body 13, creating a mechanical bond.

Alternately a thermal spray process, could be used to cause the alloy of protective layer 35 to fuse with the steel of body 13, creating a metallurgical bond. A fusing process, however, would require more heat to be applied to body 13 than an HVOF process. Another process would be to melt by torch or arc a wire or powder of an anti-corrosive alloy, such as a nickel-based alloy, onto portions of the outer surface of bit leg 17.

In the embodiment of FIG. 1, protective layer 35 is applied after cones 21 are mounted to each bit leg 17 and the head sections welded to make up; the body of bit 11. In this embodiment protective layer 35 also covers plug weld 31. Layer 35 extends from the lower end of bit leg 17 to the upper end at the edge of pressure compensator assembly 26.

Bit 11 of FIG. 1 may also contain hardfacing for enhancing abrasion resistance. A typical hardfacing comprises tungsten carbide, particles within a matrix that may be iron, nickel, cobalt or alloys thereof. The tungsten carbide particles may be a variety of types and sizes, such as sintered, past or macrocrystalline. The hardfacing may be applied in any conventional manner, such as by a welding torch melting a rod of hardfacing material. Or, the hardfacing may be applied by creating an arc into which powders or wire of the hardfacing is applied. The carbide particles of the hardfacing will be harder than the hardness of protective coating 35. The matrix of the hardfacing may also be harder.

Figure 2:
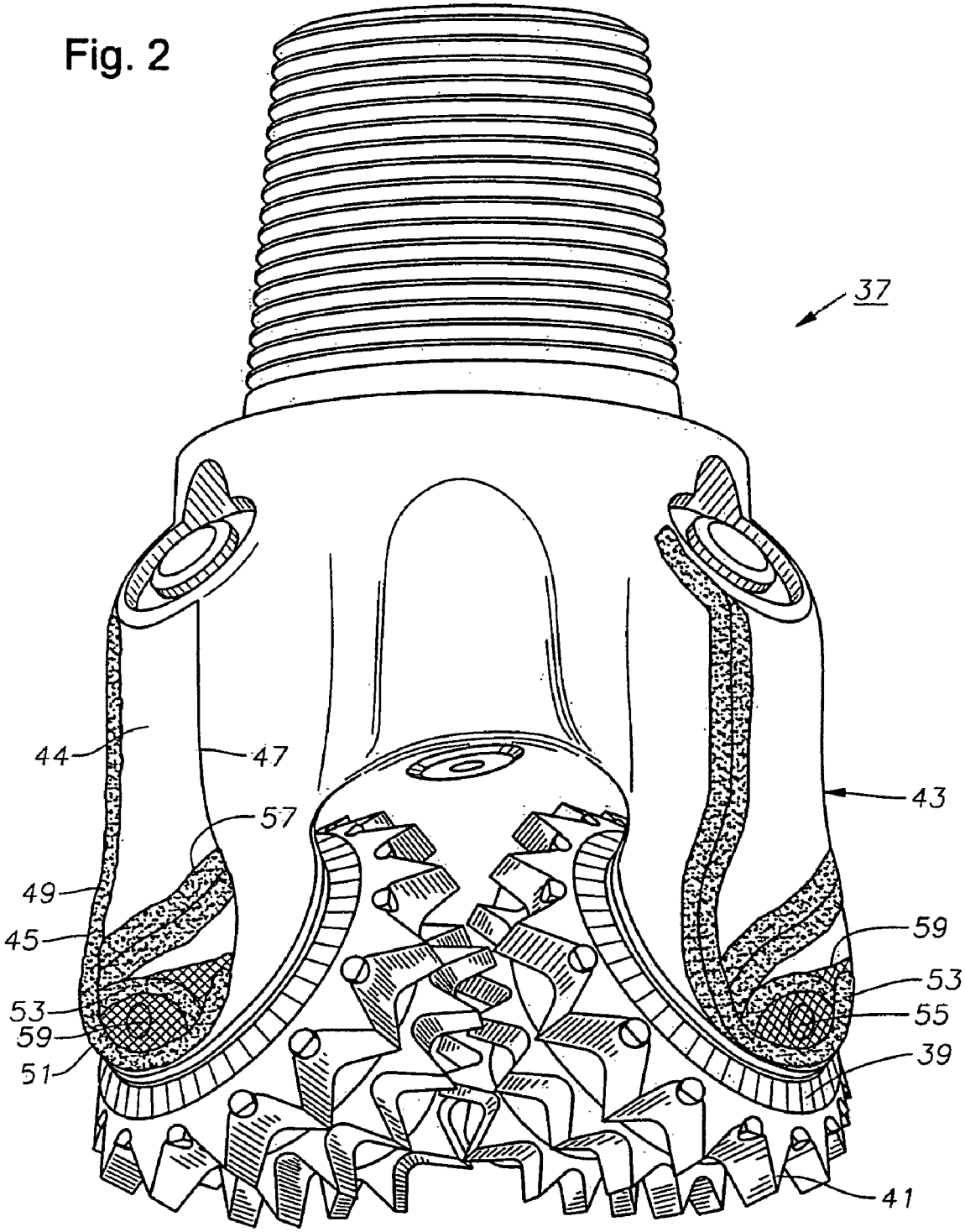
FIG. 2 is a side elevational view of a second embodiment of an earth boring bit having; a protective layer that is schematically illustrated.

FIG. 2 illustrates an alternate embodiment of a bit, which is similar to the first embodiment, but also shows hardfacing. Bit 37 of FIG. 2 is similar in construction to bit 11 of FIG. 1, but it is shown with cones 39 that contain milled teeth 41 rather than tungsten carbide compacts 23 (FIG. 1). Bit 37 could alternately contain tungsten carbide compacts rather than milled teeth 41. Bit 37 has three bit legs 43 (two shown), but it could also have four legs. Each bit leg 43 has an outer surface 44 that is a portion of a cylinder slightly less than the outer diameter of the bore. Outer surface 44 has a leading edge 45, considering the direction of rotation, and a trailing edge 47.

The hardfacing may vary in location and pattern and in the example of FIG. 2 includes the following: a leading edge hardfacing weld bead 49 that extends along leading; edge 45; a shirttail hardfacing weld bead 51 that extends along the shirttail portion, which is the lower end of bit leg 43 below ball plug weld 55; and a ball plug protective weld bead 53 that extends in arcuate path from leading edge hardfacing bead 49 to shirttail hardfacing bead 51 above ball plug weld 55. Ball plug protective bead 53 and shirttail bead 51 define an enclosed elliptical area that is free of hardfacing and contains ball plug weld 55 and a portion of bit leg outer surface 44. Also, one or more outer surface hardfacing beads 57 may extend from leading edge hardfacing bead 49 to trailing edge 47, if desired.

In the embodiment of FIG. 2, hardfacing weld beads 49, 51, 53 and 57 are applied before assembling cones 41 and welding the head sections of bit 37 together. After bit 37 is assembled with cones 41, protective layer 59 is applied to selected portions of outer surface 44 of bit leg 43, as indicated schematically by the cross hatching. Protective layer 59 is applied to areas that undergo higher stresses during drilling, such as within the elliptical space enclosed by beads 51 and 53, including ball plug weld 55. Also, preferably protective layer 59 extends from the upper portion of hardfacing bead 53 to trailing edge 47. Protective layer 59 could extend farther upward from where it is shown in FIG. 2. Hardfacing beads 49, 51, 53 and 57 are preferably masked while the HVOF process applies protective layer 59. However, masking is not essential because protective layer 59 does not impair hardfacing beads 49, 51, 53 and 57 if applied over them. Protective layer 59 may be of the same type and applied in the same manner as protective layer 35 of FIG. 1.

Figure 3:
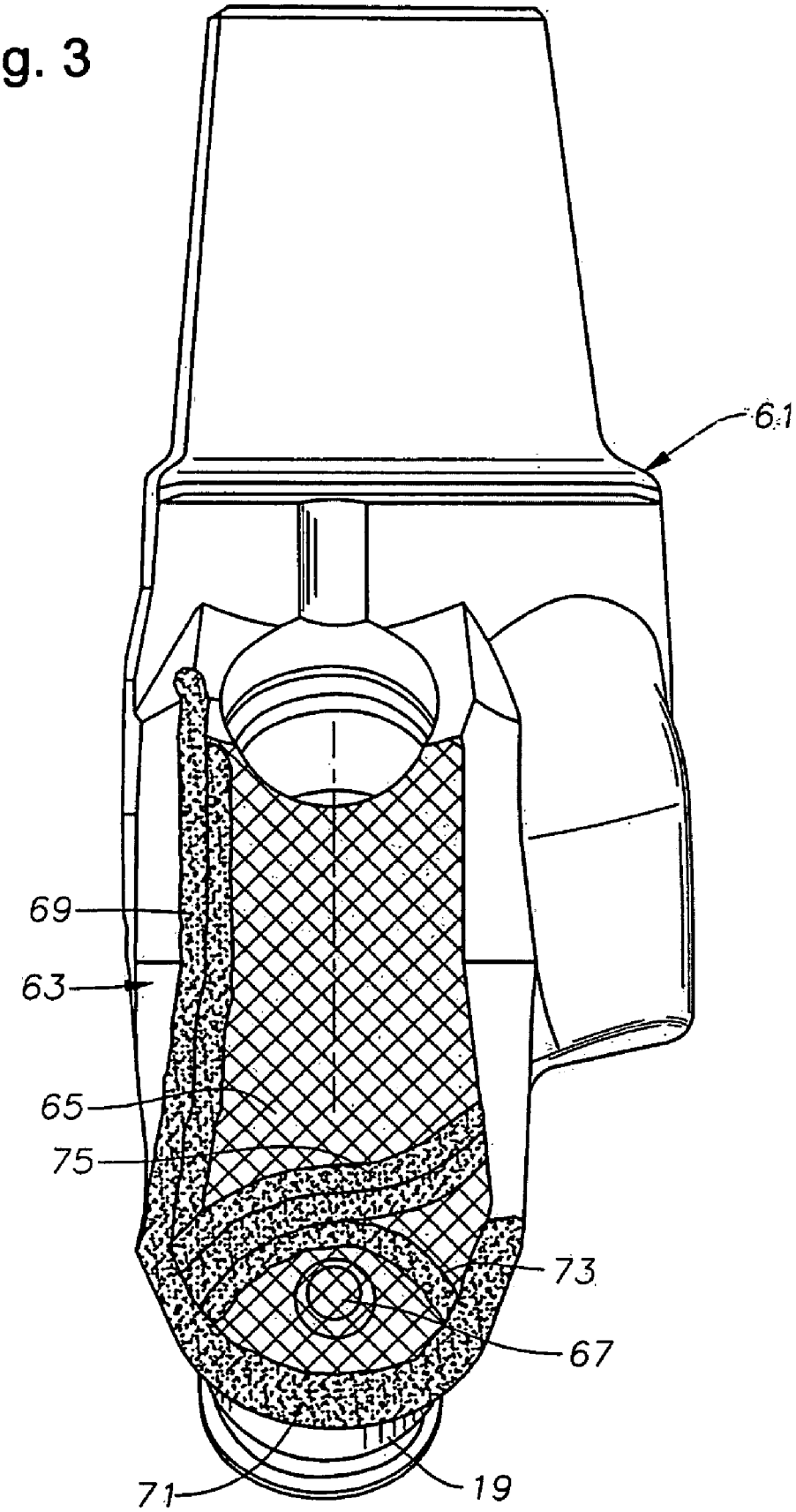
FIG. 3 is a side elevational view of one head section of an alternate embodiment of an earth boring bit shown prior to assembly but after receiving a protective layer and hardfacing.
Figure 4:
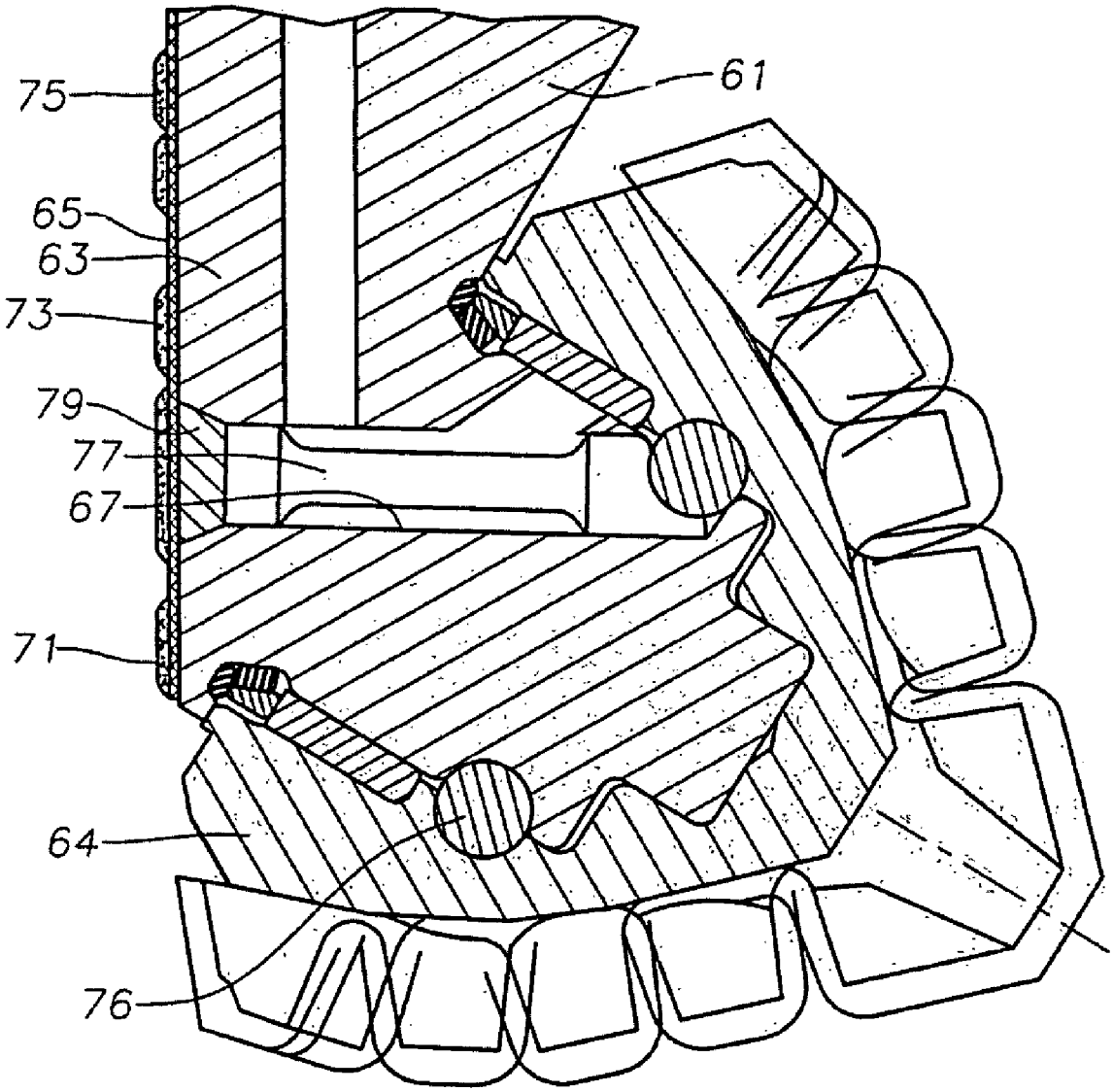
FIG. 4 is a sectional view of a portion of the head section, of FIG. 3 after the installation of a cone.

In the embodiment of FIGS. 1 and 2, protective layers 35 and 59 are applied after assembly of the bit. FIGS. 3 and 4 illustrate applying a protective layer before the bit is assembled. Referring to FIG. 3, a head section, 61 is shown prior to assembling with two other head sections into a bit. Head section 61 has a bit leg 63 that will eventually support a cone 64, as shown in FIG. 4. Before installing cone 64, a protective layer 65 is applied over portions or all of bit leg 63, including the inside surface of bit leg 63, if desired. At this point, ball plug hole 67 may be open for certain configurations that feature a ball plug. Protective layer 65 will extend around ball plug hole 67 and may extend into it. Rather than using ah HVOF process, protective layer 65 is preferably applied in a manner that causes it to fuse metallurgically, such as a thermal spray process, fusion welding or brazing.

After applying protective layer 65, hardfacing is applied to bit leg 63 over portions of protective layer 65. In the example of FIGS. 3 and 4, the hardfacing includes a leading edge bead 69, a shirttail bead 71, a ball plug protector bead 73, and an outer surface bead 75. As shown, in FIG. 4, beads 69, 71, 73 and 75 are located on protective layer 65, which is exaggerated in thickness in FIG. 4. If desired, protective layer 65 could be applied to the outer end of ball plug 77 before it is installed with bit leg 63.

After hardfacing beads 69, 71, 73 and 75 are applied, cone 64 is placed on the bearing pin of bit leg 63 and balls 76 are inserted into ball plug hole 67. Ball plug 77 is installed in ball plug hole 67. The operator welds ball plug 77 in place with a weld 79. Weld 79 could be comprised of corrosion inhibiting materials. The assembled head sections 61 are then welded together to define the bit. Alternately, rather than apply protective layer 65 to the outer end of ball plug 77 before installation, a low temperature process, such as HVOF, could be used to apply protective layer to weld 79.

While the invention has been described in only a few embodiments, it should be apparent to those skilled in the art that it is not so limited but is susceptible to various changes without departing from the scope of the invention. For example, the outer surface of the bit leg could have pressed-in tungsten carbide compacts alone or in association with the hardfacing, of the outer surface could be free of both hardfacing and compacts. In the first instance, the corrosion resistant coating could cover the outer surface, but not the compacts and hardfacing; or it could also cover the compacts and hardfacing. In the second instance, the coating could coyer all or just a portion of the outer surface of the bit legs.

The invention claimed is:

1. An earth boring bit, comprising:

a steel body having at least one leg with a depending bearing pin;

a cone having cutting elements and rotatably mounted to the bearing pin;

a wear resistant feature containing carbide and located on portions of an outer surface of the leg for reducing abrasive wear on the bit leg;

an anti-corrosive coating formed on the outer surface of the leg on portions not containing the wear resistant feature, the coating having a lesser hardness than the wear resistant feature.

2. The bit according to claim 1, wherein part of the coating extends at least partially over the wear resistant feature.

3. The bit according to claim 1, wherein the coating comprises at least 50% nickel.

4. The bit according to claim 1, further comprising:

a ball plug weld on the outer surface of the leg; and wherein:

the coating is located above and below the ball plug weld.

5. A bit according to claim 1, further comprising:

a ball plug weld on the outer surface of the leg; and wherein:

the coating overlays the ball plug weld.

6. The bit according to claim 1, wherein the wear resistant feature comprises:

a layer of hardfacing on portions of the outer surface of the leg, leaving other portions of the outer surface of the leg free of the layer of hardfacing; and wherein the coating is located on said other portions of the outer surface of the leg.

7. The bit according to claim 1, wherein the coating is also located on an inner surface of the leg.

8. The bit according to claim 1, wherein the wear resistant feature comprises a layer of hardfacing formed of carbide particles in a matrix of iron, nickel or cobalt or alloys thereof and applied to at least part of the outer surface of the bit leg.

9. The bit according to claim 1, wherein the wear resistant feature comprises:

a bead of hardfacing on part of the outer surface of the leg, the bead of hardfacing being formed of carbide particles in a matrix of iron, nickel or cobalt or alloys thereof.

10. The bit according to claim 1, wherein the coating comprises a polymer.

11. The earth boring bit, comprising:

a steel body having at least one leg with a depending bearing pin;

a cone having cutting elements and rotatably mounted to the bearing pin;

a layer of hardfacing applied to part of an outer surface of the leg, the hardfacing having carbide particles in a matrix of iron, nickel or cobalt or alloys thereof; and a corrosion resistant coating formed on parts of the outer surface of the leg that are free of the layer of hardfacing.

12. The bit according to claim 11, wherein the coating has a lesser hardness than the matrix of the layer of hardfacing.

13. The bit according to claim 11, wherein the coating has a lesser hardness than the body.

14. The hit according to claim 11, wherein the coating comprises an alloy selected from the group consisting of iron, nickel, chromium, copper, aluminum, zirconium, and silicon.

15. The bit according to claim 11, wherein the coating comprises a nickel-based alloy.

16. The bit according to claim 11, wherein at least 50% of the coating comprises nickel.

17. The bit according to claim 11, further comprising:

a ball plug weld on the outer surface of the leg; and wherein:

the coating is located above and below the ball plug weld.

18. The bit according to claim 11, further comprising:

a ball plug weld on the outer surface of the leg; and wherein:

the coating overlays the ball plug weld.

19. An earth boring bit, comprising:

a steel body having at least one leg with a depending bearing pin;

a cone having cutting elements and rotatably mounted to the bearing pin;

a ball plug weld on an outer surface of the leg;

a layer of hardfacing applied to part of the outer surface of the leg, the hardfacing having carbide particles in a matrix of iron, nickel or cobalt or alloys thereof; and a corrosion resistant coating containing at least 50% nickel and formed on parts of the outer surface of the leg that are free of the layer of hardfacing and located both above and below the ball plug weld.

20. The hit according to claim 19, wherein the coating is also located on an inner surface of the leg.

21. The bit according to claim 19, wherein the coating is also located on the ball plug weld.

* * * * *

UNITED STATES PATENT AND TRADEMARK OFFICE

CERTIFICATE OF CORRECTION

PATENT NO. : 7,823,664 B2
APPLICATION NO. : 12/191915
DATED : November 2, 2010
INVENTOR(S) : Alan J. Massey et al.

It is certified that error appears in the above-identified patent and that said Letters Patent is hereby corrected as shown below:

On the title page, item (57), in the Abstract:

line 4, after “hardfacing” insert --is--

Column 1, line 53, delete “along” and insert --alone--
Column 3, line 60, after “extends in” insert --an--
Column 4, line 62, after “hardfacing,” delete “of” and insert --or--

Signed and Sealed this
Seventeenth Day of May, 2011

David J. Kappos

David J. Kappos
*Director of the United States Patent and Trademark Office*